US011365529B2

(12) United States Patent
Bjerke

(10) Patent No.: US 11,365,529 B2
(45) Date of Patent: Jun. 21, 2022

(54) BOLT RETENTION ASSEMBLY WITH EXTENDED TRAVEL FOR A WORK TOOL

(71) Applicant: Caterpillar Inc., Peoria, IL (US)

(72) Inventor: Nathan R. Bjerke, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 73 days.

(21) Appl. No.: 16/750,092

(22) Filed: Jan. 23, 2020

(65) Prior Publication Data

US 2021/0230845 A1 Jul. 29, 2021

(51) Int. Cl.
*E02F 9/28* (2006.01)

(52) U.S. Cl.
CPC ..... *E02F 9/2825* (2013.01)

(58) Field of Classification Search
CPC ..... E02F 9/2816; E02F 9/2825; E02F 9/2833; E02F 9/2858
USPC ..... 37/455
See application file for complete search history.

(56) References Cited

U.S. PATENT DOCUMENTS

| | | | | |
|---|---|---|---|---|
| 888,047 | A * | 5/1908 | Sherrerd | E02F 9/2825 37/454 |
| 1,697,536 | A * | 1/1929 | Miley | E02F 9/2825 37/455 |
| 2,256,488 | A * | 9/1941 | Murtaugh | E02F 9/2825 37/455 |
| 2,311,463 | A * | 2/1943 | Page | E02F 9/2833 37/455 |
| 2,385,395 | A * | 9/1945 | Baer | E02F 9/2833 37/458 |
| 2,925,673 | A * | 2/1960 | Sennholtz | E02F 9/2833 37/455 |
| 4,335,532 | A * | 6/1982 | Hahn | E02F 9/2825 37/459 |
| 4,671,000 | A * | 6/1987 | Kim | E02F 9/2816 172/713 |
| 6,240,663 | B1 | 6/2001 | Robinson et al. | |
| 8,800,178 | B2 | 8/2014 | Rol Corredor et al. | |
| 9,371,631 | B2 * | 6/2016 | Karlsson | E02F 9/2883 |
| 9,447,564 | B2 | 9/2016 | Kunz | |
| 9,632,200 | B2 * | 4/2017 | Tasovski | G01V 3/104 |
| 9,909,285 | B2 * | 3/2018 | Bjerke | E02F 9/2883 |
| 10,246,856 | B2 | 4/2019 | Rol Corredor et al. | |

(Continued)

FOREIGN PATENT DOCUMENTS

| | | |
|---|---|---|
| CN | 105271081 B | 8/2019 |
| FR | 2815059 B1 | 3/2003 |

(Continued)

*Primary Examiner* — Gary S Hartmann
(74) *Attorney, Agent, or Firm* — Law Office of Kurt J. Fugman LLC

(57) ABSTRACT

A bolt retention assembly defines a horizontal direction, a vertical direction, and a lateral direction that is perpendicular to the vertical direction and the horizontal direction. The bolt retention assembly includes an adapter including a forward abutment portion and a rearward horizontally oriented saddle portion. The adapter may also define an interior aperture. The bolt retention assembly further includes a slide including a forward threaded portion configured to fit within the interior aperture of the adapter, and a rearward horizontally oriented pronged portion configured to pass through the rearward horizontally oriented saddle portion of the adapter.

13 Claims, 9 Drawing Sheets

(56) References Cited

U.S. PATENT DOCUMENTS

| | | | | |
|---|---|---|---|---|
| 10,947,704 | B2 * | 3/2021 | Bjerke | E02F 9/2825 |
| 2004/0060208 | A1 * | 4/2004 | Wagner | E02F 9/285 37/452 |
| 2017/0073939 | A1 | 3/2017 | Bjerke et al. | |

FOREIGN PATENT DOCUMENTS

| | | | |
|---|---|---|---|
| WO | 2017196521 | | 11/2017 |
| WO | 2019048724 | A1 | 3/2019 |

* cited by examiner

BOLT RETENTION ASSEMBLY WITH EXTENDED TRAVEL FOR A WORK TOOL

TECHNICAL FIELD

The present disclosure relates to the field of machines that perform work on a material using work implements such as mining, construction and earth moving machines and the like. Specifically, the present disclosure relates to a bolt retention assembly used to attach wear member such as shrouds to a work tool and the like.

BACKGROUND

During normal use on machines such as mining, construction, and earthmoving machines and the like, work implements such as blades or buckets, etc. have edges that experience wear. It is not uncommon for these edges to be protected by various types of wear members. These wear members are intended to be sacrificial, protecting the edges of the blade so that the more expensive blade or other type of work implement does not need to be replaced. It is desirable that these wear members be replaced before damage or wear occurs on the working edges of the work implement.

Removal and/or replacement of a wear member may require disassembly of the wear members from the edge of the work tool, and assembly of a repaired or a new wear member on the work implement. The machine must be taken out of service to perform such replacement or repair. The time required to disassemble and reassemble a wear member may be dictated by the mechanism used to retain the wear member on the work tool. It is desirable to have a retention system or assembly that allows for quick assembly and disassembly at a worksite to allow the machine to be returned to service as quickly as possible.

U.S. Pat. No. 6,240,663 of Robinson, issued on Jun. 5, 2001 ("the '663 patent"), discloses a resilient connection system for attaching a wear member to an excavating lip structure. In particular, the '663 patent discloses a wear member that has a front portion with two rearwardly extending legs including an upper leg which is disposed on top of a lip of a bucket and a lower leg, which is disposed below the lip. The '663 patent further discloses that a connection member is welded to the bucket. The connection member includes an upstanding boss that includes a circular opening.

Likewise, the upper leg of the wear member of the '663 patent includes a projection. A fastener passing through the circular opening in the boss engages with the projection in the upper leg to attach the wear member to the connection member. The connection member of the '663 patent also includes two spring assemblies disposed on either side of the fastener. Each spring assembly includes a rod attached at one end to the connection member and a spring circumscribed around the rod. The spring is retained at the other end of the rod by a snap ring. The rods in each spring assembly of the '663 patent engage with openings in downwardly projecting bosses of the upper leg of the wear member so that the springs are retained between the bosses and the connection member. As the fastener is tightened, the spring assemblies of the '663 patent are compressed providing a biasing force to urge the wear member onto the lip. The '663 patent also discloses that a protective shroud is installed to protect the components of the retention system.

However, assembly of the retention system in the '633 patent may be complicated or cumbersome. Also, the amount of force used to retain the wear member to the work implement may be limited by the spring force provided in the retention system of the '633 patent. If this spring force is overcome, then the wear member may undesirably fall off the work implement.

In addition, the various components of the retention system may wear, decreasing the force or distance of disengagement of the retention system. This too may be undesirable.

SUMMARY OF THE DISCLOSURE

A bolt retention assembly according to an embodiment of the present disclosure defines a horizontal direction, a vertical direction, and a lateral direction that is perpendicular to the vertical direction and the horizontal direction. The bolt retention assembly may comprise an adapter including a forward abutment portion and a rearward horizontally oriented saddle portion. The adapter may also define an interior aperture. The bolt retention assembly may further comprise a slide including a forward threaded portion configured to fit within the interior aperture of the adapter, and a rearward horizontally oriented pronged portion configured to pass through the rearward horizontally oriented saddle portion of the adapter. The rearward horizontally oriented saddle portion defines a maximum horizontal dimension of the rearward horizontally oriented saddle portion, and the rearward horizontally oriented pronged portion defines a maximum horizontal dimension of the rearward horizontally oriented pronged portion that is equal to or greater than the maximum horizontal dimension of the rearward vertically oriented cradle portion such that the slide is free to move horizontally relative to the adapter and extend horizontally past the adapter.

A slide for use with a bolt retention assembly according to an embodiment of the present disclosure is provided. The slide may define a horizontal direction, a vertical direction, and a lateral direction that is perpendicular to the horizontal direction and the vertical direction. The slide may comprise a forward threaded portion, and a rearward horizontally oriented pronged portion.

An adapter for use with a bolt retention assembly according to an embodiment of the present disclosure is provided. The adapter may define a horizontal direction, a vertical direction, and a lateral direction that is perpendicular to the horizontal direction and the vertical direction. The adapter may comprise a subassembly including a front adapter member comprising a forward abutment portion, and a rear adapter member comprising a rearward horizontally oriented saddle portion that defines a central horizontally extending clearance hole and four horizontally extending thru-apertures that are spaced about the central horizontally extending thru-hole forming a rectangular array in a plane that is parallel to the lateral direction and the vertically direction. The adapter may also define an interior aperture that is in communication with the central extending thru-hole and the four horizontally extending thru-apertures.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

shrouds) that are attached to the lip of the bucket using a bolt retention assembly according to various embodiments of the present disclosure.

Figure 1:
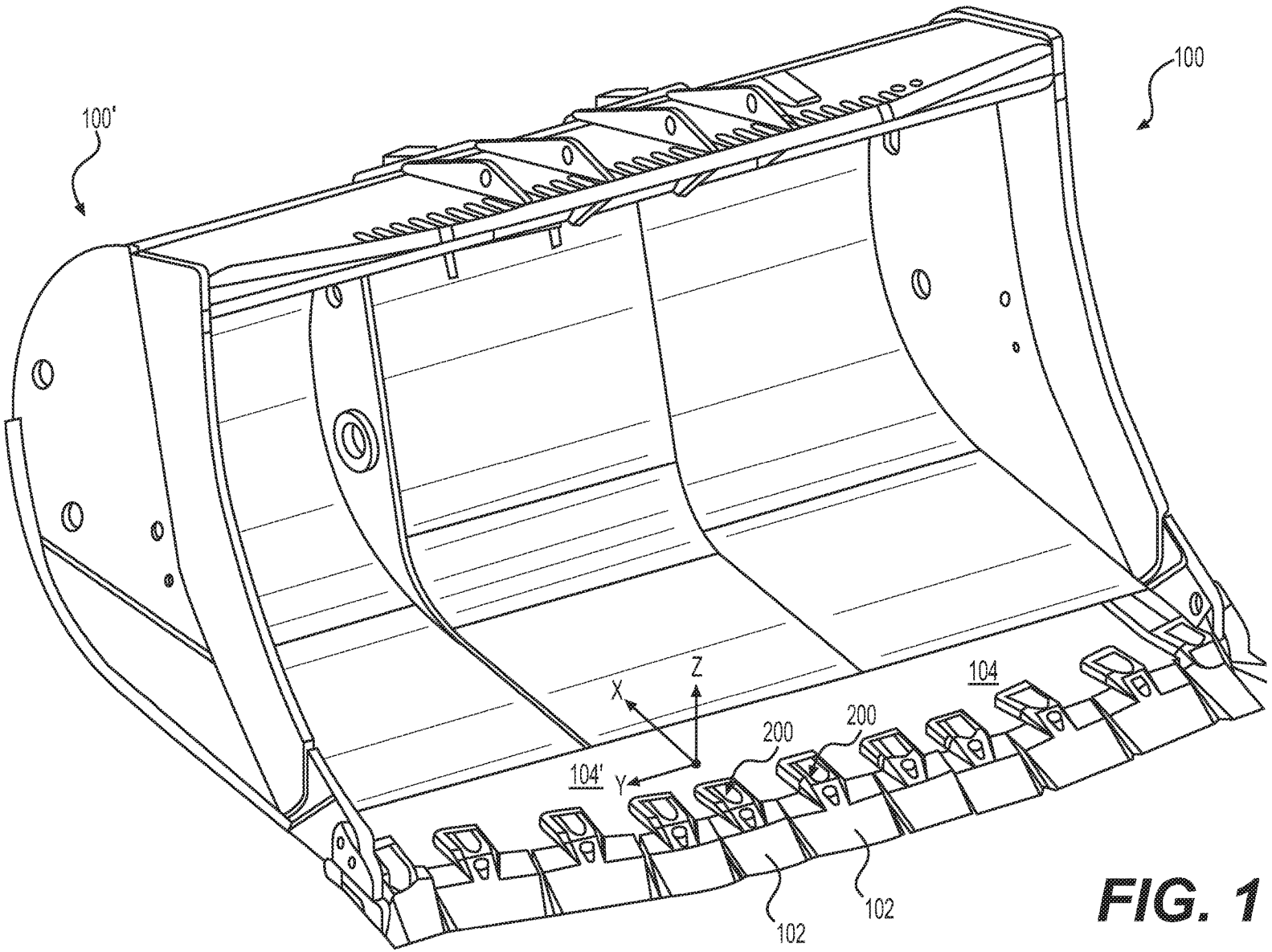
FIG. 1 is a perspective view of a work implement in the form of a bucket assembly that uses wear members (e.g.
Figure 2:
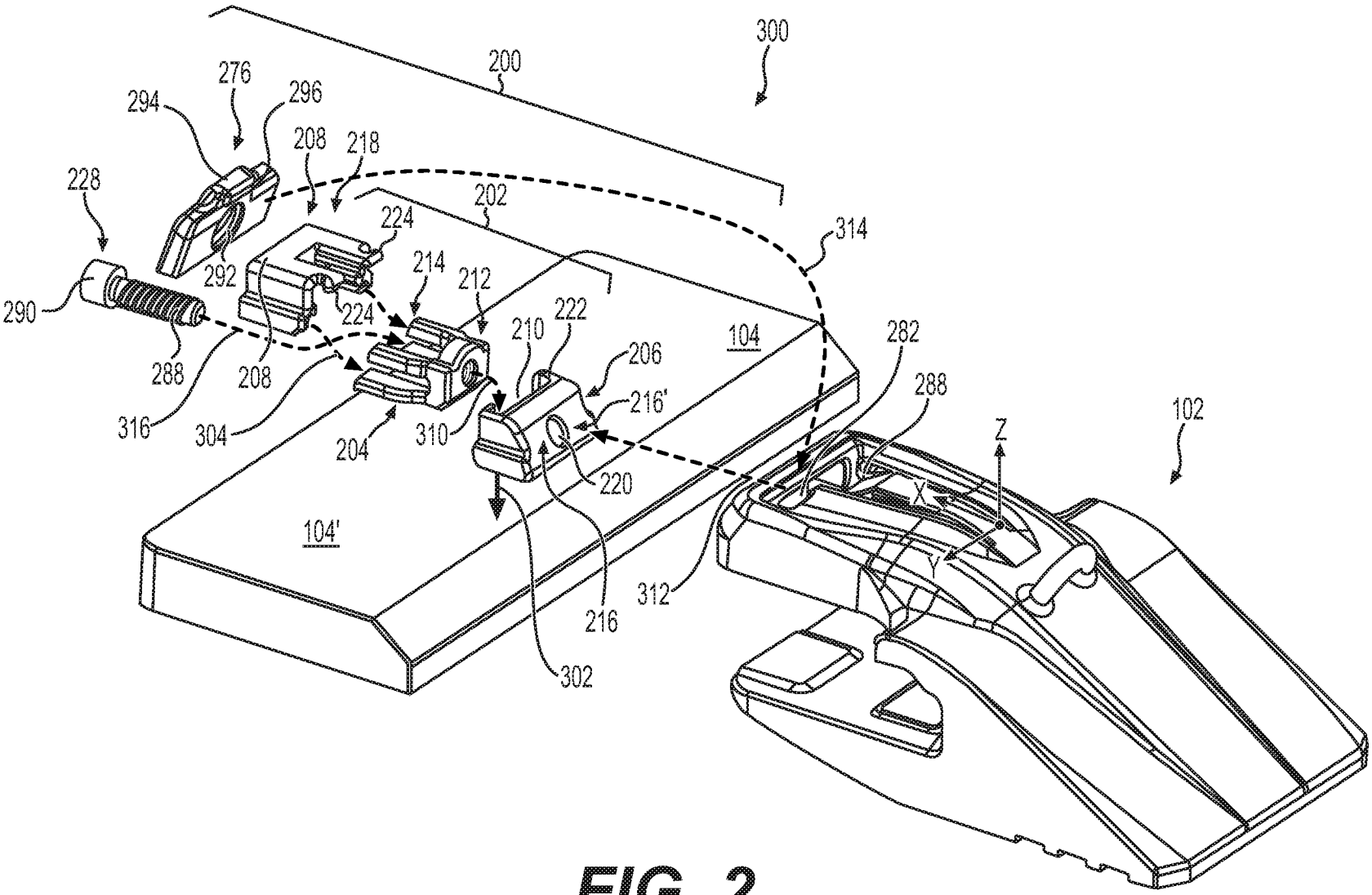

FIG. 2 is an exploded assembly view of a bolt retention assembly according to an embodiment of the present disclosure used to attach a wear member (e.g. a shroud) to the lip of the bucket assembly of FIG. 1.

Figure 3:
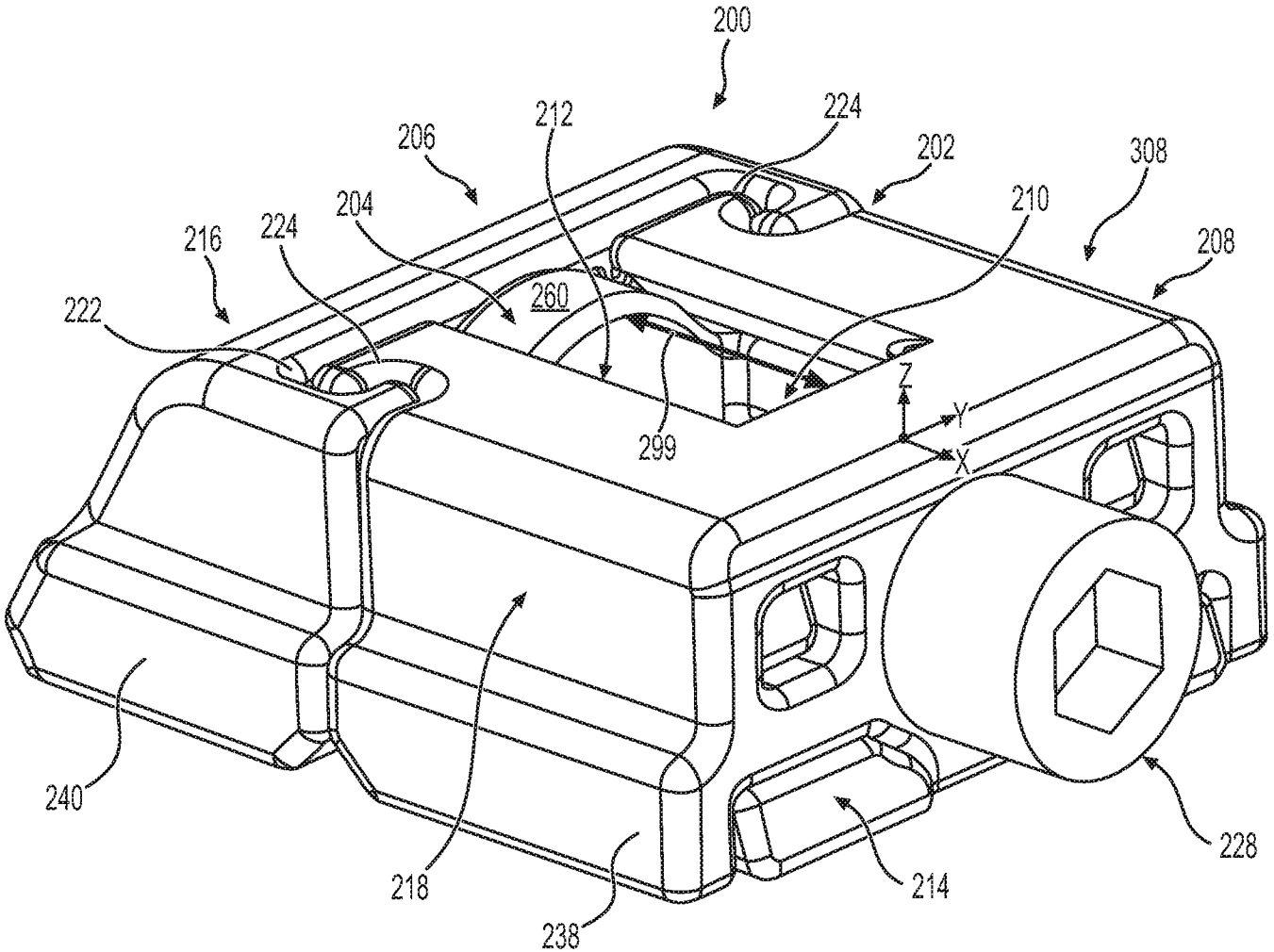

FIG. 3 illustrates the bolt retention assembly of FIG. 2 assembled with the slide in a forward position when the bolt has been loosened. The components shown may be provided as a kit or subassembly.

Figure 4:
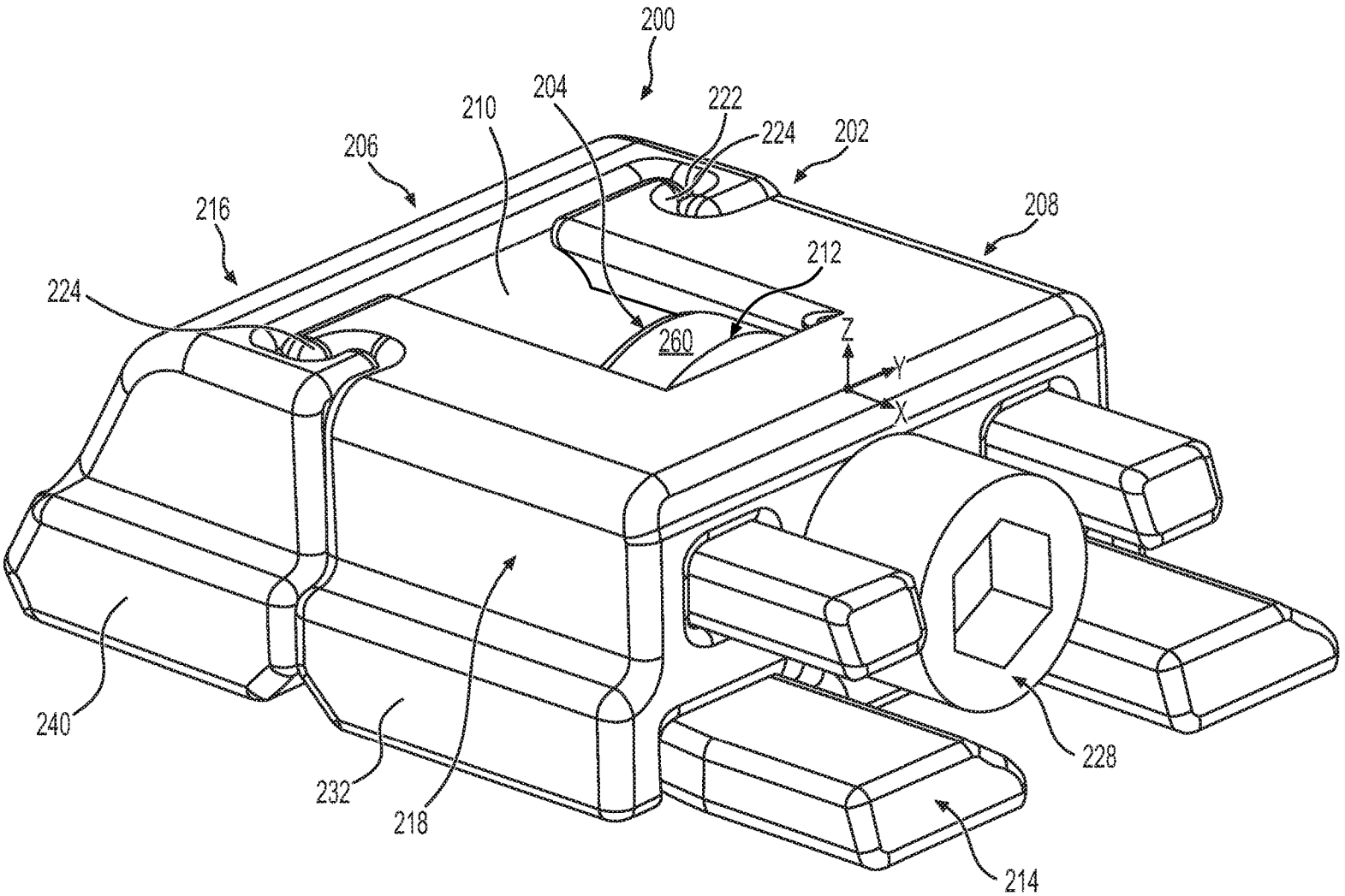

FIG. 4 illustrates the bolt retention assembly of FIG. 3 assembled with the slide in a rearward position when the bolt has been tightened. Projections of the slide are shown to protrude for contacting the retainer plate. The projections allow for increased travel of the retainer plate, helping to compensate for wear of the components of the retention assembly and to maximize the distance of engagement or disengagement of the retainer plate relative with respect to the wear member.

Figure 5:
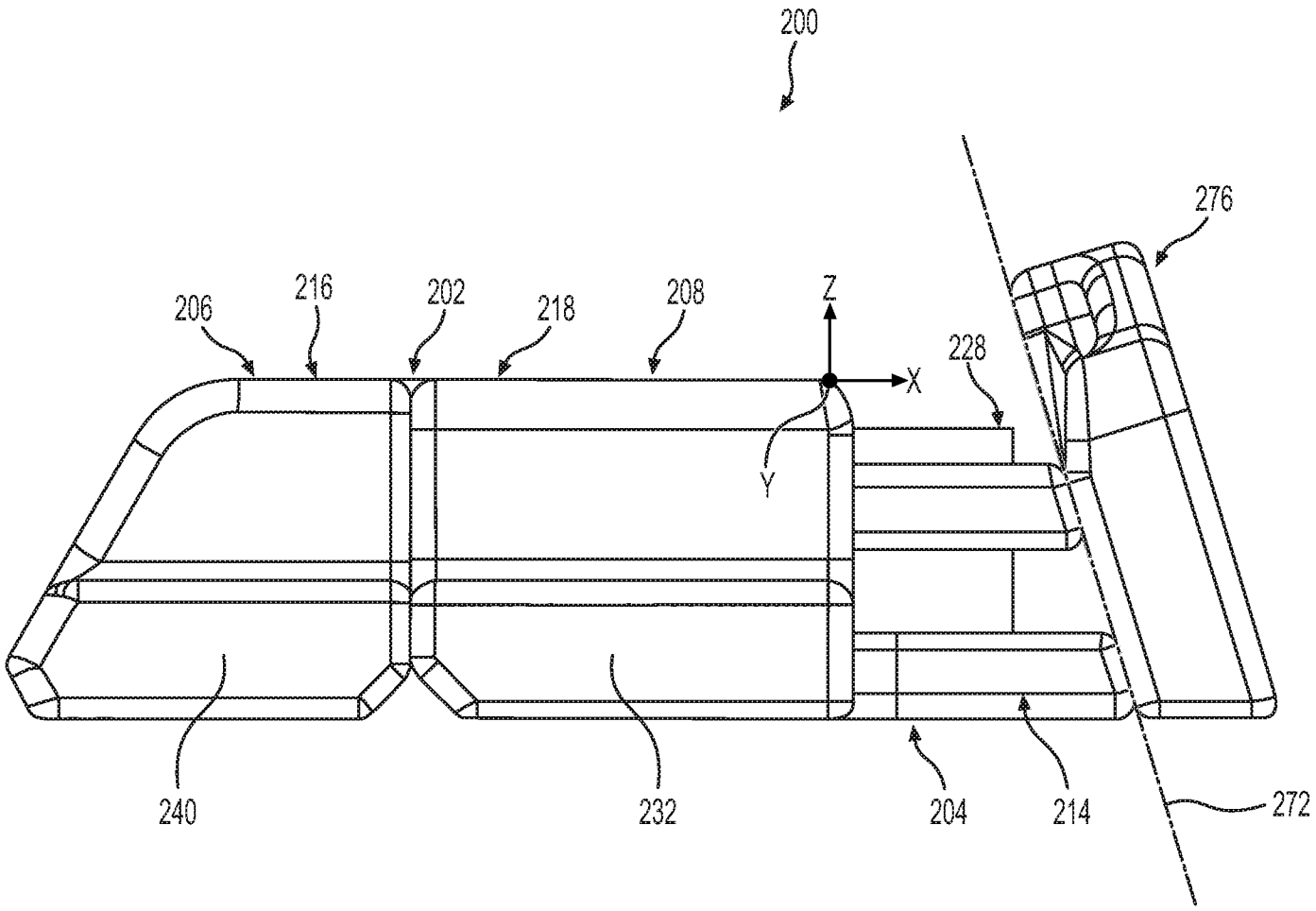

FIG. 5 is a side view of the bolt retention assembly of FIG. 4 showing the projections engaging the retainer plate.

Figure 6:
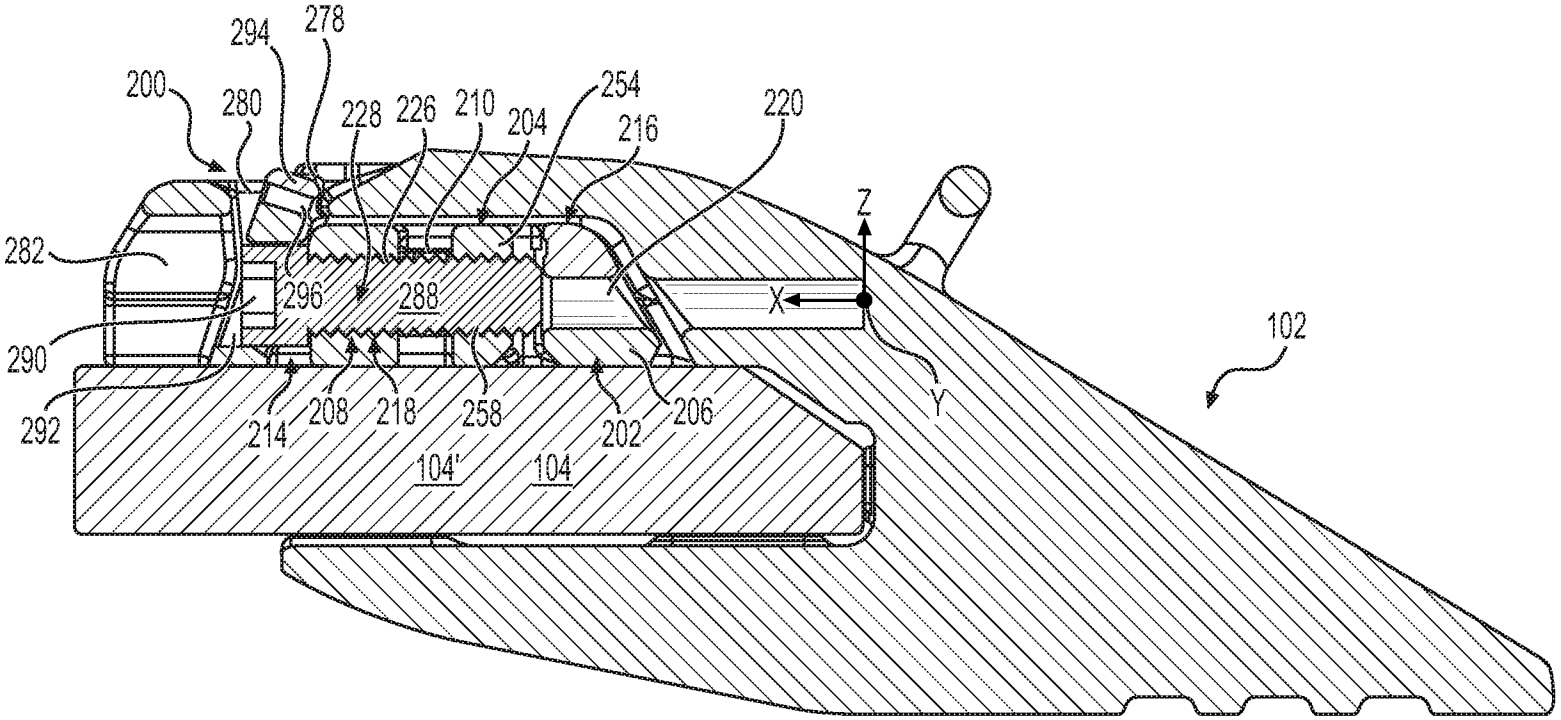

FIG. 6 is a partial sectional view of the bolt retention assembly of FIG. 5 after being tightened, causing the slide to contact the retainer plate and prevent removal of the retainer plate from the wear member.

Figure 7:
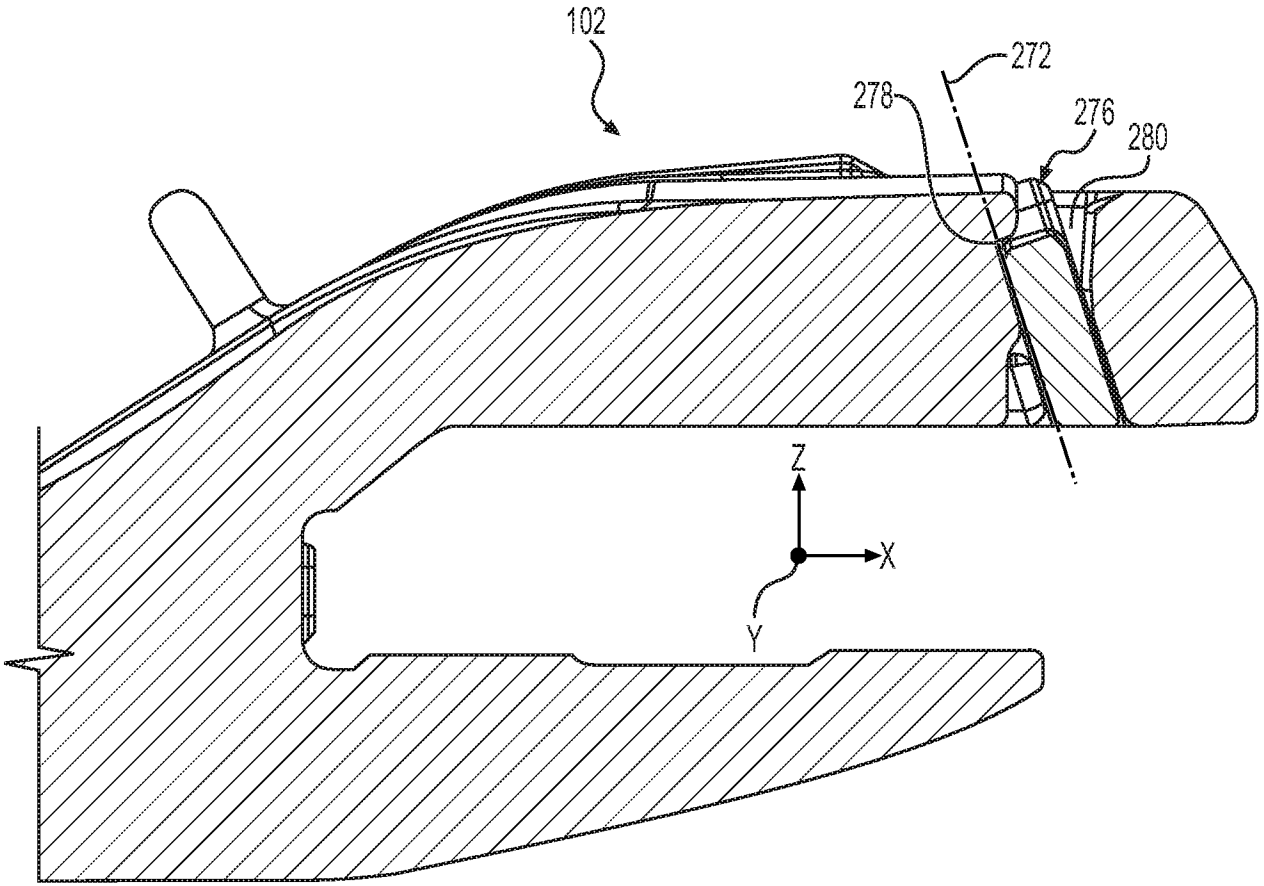

FIG. 7 is a sectional view of the wear member and the retainer plate of FIG. 6.

Figure 8:
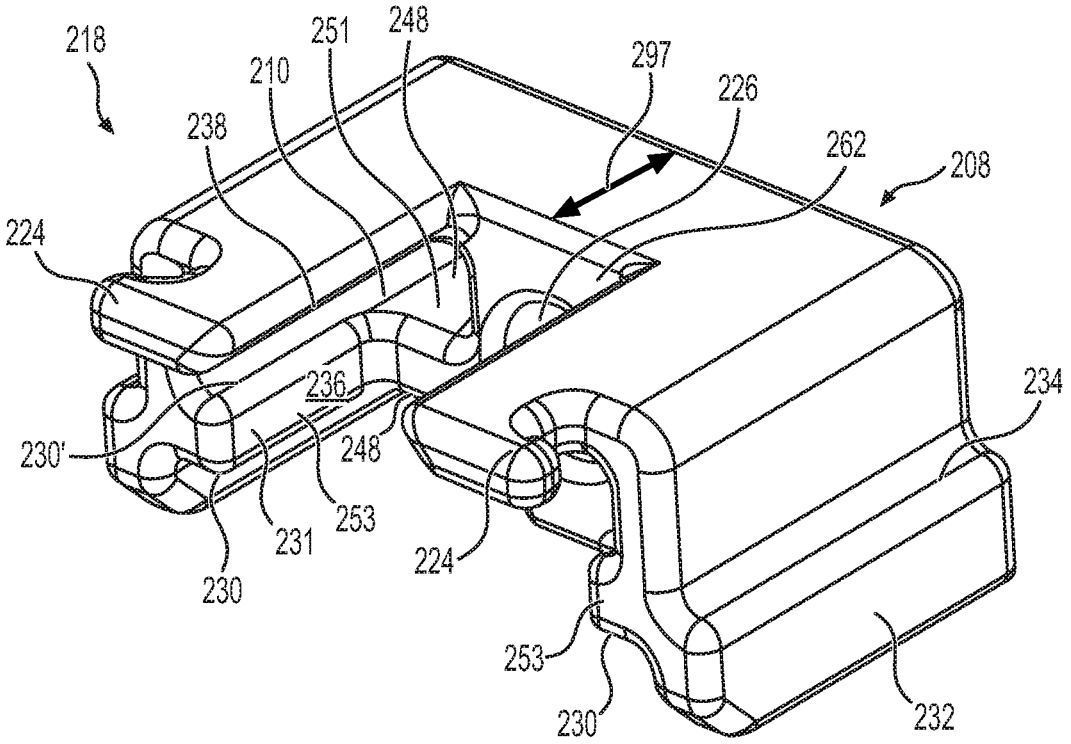

FIG. 8 is a front oriented perspective view of the rear adapter member of the bolt retention assembly of FIGS. 2 thru 6.

Figure 9:
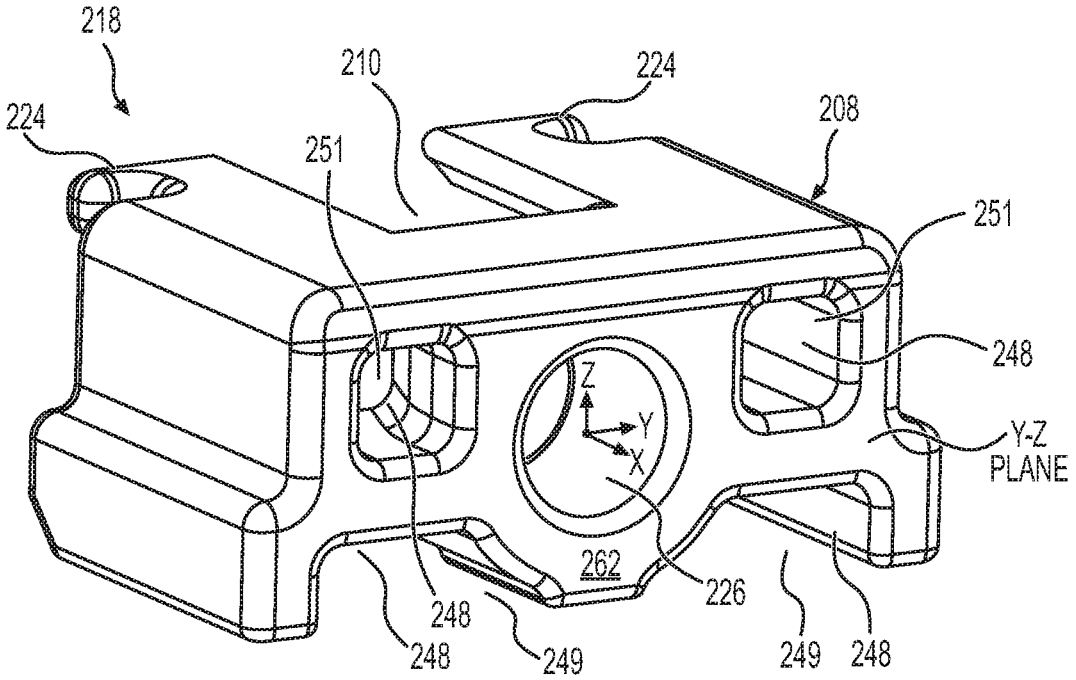

FIG. 9 is a rear oriented perspective view of the rear adapter member of the bolt retention assembly of FIGS. 2 thru 6.

Figure 10:
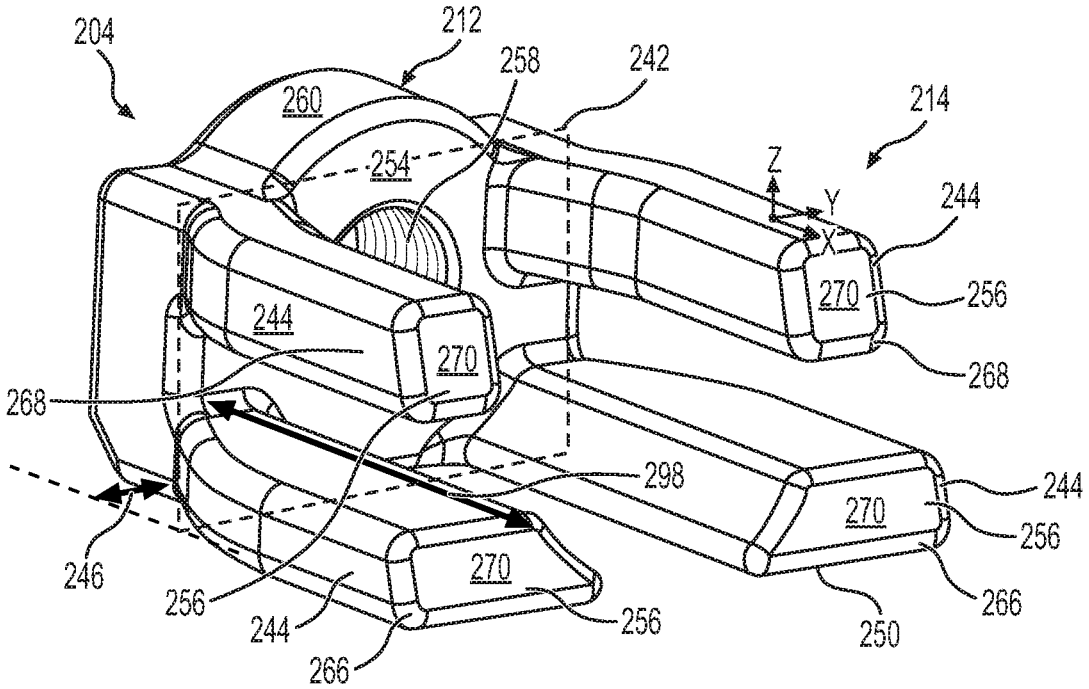

FIG. 10 is a rear oriented perspective view of the slide of the retention assembly of FIGS. 2 thru 6.

Figure 11:
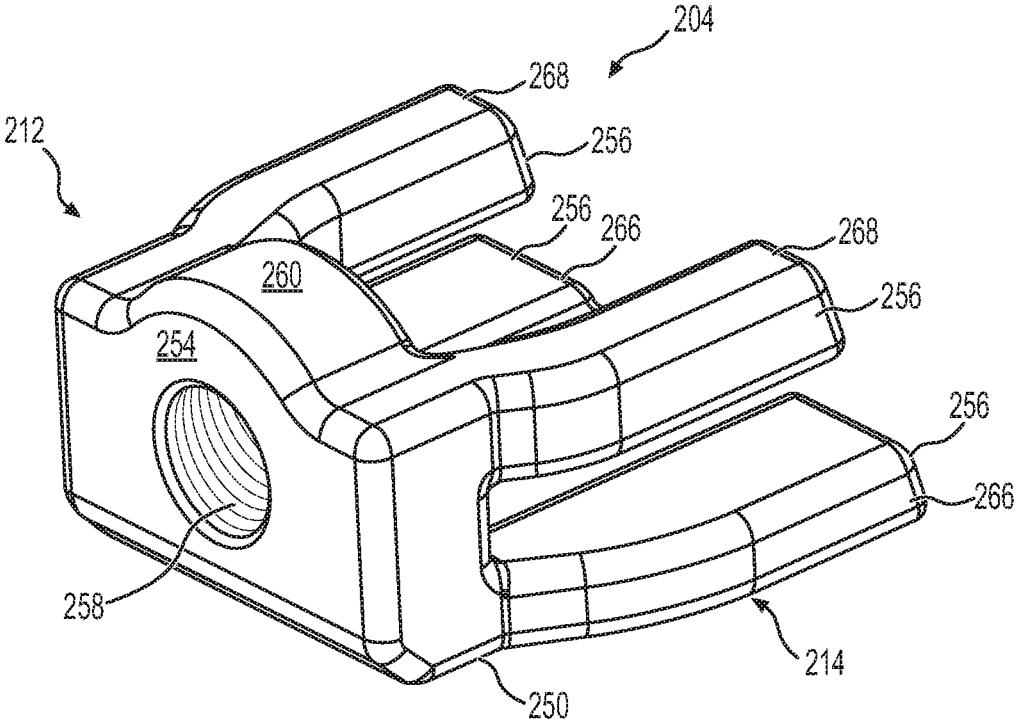

FIG. 11 is a front oriented perspective view of the slide of the retention assembly of FIGS. 2 thru 6.

DETAILED DESCRIPTION

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100a, 100b or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

Various embodiments of a bolt retention assembly, a wear member such as a shroud, tool adapter, tool bit, tip, etc. that is configured to be attached to a working edge such as a lip of a work implement such as a bucket, a slide of a bolt retention assembly, and an adapter of a bolt retention assembly will now be described, etc.

A bolt retention assembly 200 according to an embodiment of the present disclosure may be understood with reference to FIGS. 1-11. Looking at FIGS. 1 and 2, the bolt retention assembly 200 may define a horizontal direction (X direction), a vertical direction (Z direction), and a lateral direction (Y direction) that is perpendicular to the vertical direction (Z direction), and the horizontal direction (X direction). The bolt retention assembly 200 may be used to attach a wear member 102 such as a shroud to a work edge 104 of a work implement 100 (e.g. a lip 104' of a bucket assembly 100'). Other applications for attaching a wear member 102 are possible using the bolt retention assembly 200.

As shown in FIGS. 2 thru 6, the bolt retention assembly 200 may comprise an adapter 202 and a slide 204. The adapter 202 may include a forward abutment portion 206 and a rearward horizontally oriented saddle portion 208. The adapter 200 may also define an interior aperture 210. The slide 204 may include a forward threaded portion 212 configured to fit within the interior aperture 210 of the adapter 202 allowing the slide 204 to move back and forth within the interior aperture 210. The slide 204 may also include a rearward horizontally oriented pronged portion 214 configured to pass through the rearward horizontally oriented saddle portion 208 of the adapter 202.

Thus, the adapter 202 and the slide 204 may be connected to each other while allowing the slide 204 the freedom of movement necessary to lock and unlock a wear member 102 onto the work edge 104 of the work implement 100 (see FIGS. 3 and 4 for examples of this movement). In particular embodiments, the interior aperture 210 may be configured as an elongated slot along the X direction to allow the slide 204 to move back and forth along the X direction.

With continued reference to FIGS. 2 thru 6, the adapter 202 may be split into a front adapter member 216 and a rear adapter member 218 configured to be attached to the front adapter member 216. This design may allow the bolt retention assembly 200 to be used with weld-on bosses which are already in the field on work implements. These weld-on bosses 216' may function as the front adapter member 216. In such a case, a horizontally extending thru-hole 220 (see FIGS. 2 and 6) may pass through the forward abutment portion 206 of the front adapter member 216 but it is to be understood that this horizontally extending thru-hole 220 may be omitted in various embodiments. In some embodiments, the adapter 202 may be manufactured from a unitary piece of material instead of being split.

When the adapter is a split assembly as best seen in FIGS. 2 thru 4, the front adapter member 216 may include a vertically extending T-slot 222 and the rear adapter member 218 may include diametrically opposing hook portions 224 (may also be referred to as stem portions) configured to fit within the T-slot 222, being placed therein vertically (along the negative Z direction). Once assembled, the rear adapter member 218 cannot move in the positive X direction or the negative X direction since various portions of the rear adapter member 218 would contact the various portions of the front adapter member 216, which may already have been attached to the work edge 104 via welding, fastening, etc.

Also, as best seen in FIGS. 6, 8, and 9, the rearward horizontally oriented saddle portion 208 of the rear adapter member 218 defines a horizontally extending clearance hole 226 that allows the bolt 228 to pass through the rearward horizontally oriented saddle portion 208 along the negative X direction and reach the forward threaded portion 212 of the slide 204 and mate therewith when attaching the bolt 228 to the assembly 200 or using the bolt 228 to tighten or loosen the assembly 200.

As best seen in FIG. 8, the rearward horizontally oriented saddle portion 208 of the rear adapter member 218 may include an internal rail member 231 that defines a downward vertically (along the negative Z direction) facing ledge 230, and an upwardly vertically facing ledge 230' that are disposed in the interior aperture 210. Furthermore, the rear adapter member 218 may include an external rail member 232 extending laterally outwardly (negative Y direction on one side and positive Y direction on the other side) from the rearwardly horizontally oriented saddle portion 208 defining a top surface 234 that is substantially coplanar with the downwardly vertically facing ledge 230 (e.g. within a distance vertically measured of +/−2 mm).

Likewise, the internal rail member 231 may define a first inward lateral extremity 236, and at least one of the diametrically opposing hook portions 224 of the rear adapter member 218 may define a second inward lateral extremity 238 that is spaced laterally away from the first inward lateral extremity 236 toward the interior, so that the top portion of the rear adapter member 218 overhangs the internal rail member 231 and slide 204 (see also FIGS. 3 and 4). The front adapter member 216 may include a rail 240 extending laterally outwardly from the front adapter member 218 that is coextensive with the external rail member 232 of the rear adapter member 218 (see FIGS. 3 thru 5).

Other features that may be present or omitted from the rear adapter member 218 will now be further discussed with reference to FIGS. 8 and 9. The four horizontally extending thru-apertures 248 are spaced about the central horizontally extending clearance hole 226 forming a rectangular array in a plane parallel to the lateral and the vertical direction (i.e. the Y-Z plane) for allowing the prongs of the slide to pass through the rear adapter member. Also, the interior aperture 210 may be in communication with the central horizontally extending clearance hole 226 and the four horizontally extending thru-apertures 248. The horizontally extending clearance hole 226 of the rear adapter member 218 may allow the bolt 228 to pass through to reach the slide 204 and may also be coaxial with the horizontally extending thru-hole 220 of the front adapter member 216 (see FIG. 6).

In addition as best seen in FIG. 9, the four horizontally extending thru-apertures 248 may include two bottom slots 249 that are open in a downward vertical direction, and two top apertures 251 that have rectangular perimeters. The rear adapter member 218 may further comprise two internal ribs 253 that form the downward vertically facing ledges 230 and at least partially define the rectangular perimeter of the two top apertures 251 (may also partially define the two bottom slots 249, see FIGS. 8 and 9).

Looking at FIGS. 6, 10 and 11, the slide 204 will be further discussed. The slide 204 may include a forward threaded portion 212 including a first vertical wall 254 that defines a threaded aperture 258 that mates with the bolt. In other embodiments, a nut may be provided that is configured to fit in a front horizontally oriented cradle portion to form the forward threaded portion 212 and be retained therein via a slight press fit, welding, adhesives, etc.

Focusing on FIGS. 10 and 11, the first vertical wall 254 may have a domed top portion 260 that is radially offset from the threaded aperture 258 to fit into and be slightly covered by the rear adapter member 218 (best seen in FIGS. 4 and 5). Also, the bottom surface 250 of the slide 204 may be flat to facilitate its sliding motion.

The rearward horizontally oriented pronged portion 214 may include four horizontally extending prongs 256 that are attached to the first vertical wall 254. In FIGS. 8 and 9, the second vertical wall 262 of the rearward horizontally oriented saddle portion 208 of the rear adapter member 218 may define four apertures 264 that extend through the second vertical wall 262 and that are configured to allow the four horizontally extending prongs 256 to pass through the second vertical wall 262. Other configurations are possible in other embodiments.

Other details of the slide 204 will now be discussed focusing on FIGS. 10 and 11 that also may be present or omitted in various embodiments of the present disclosure. The four horizontally extending prongs 256 may include two bottom prongs 266 that are spaced horizontally away from each other, and two top prongs 268 that are spaced vertically away from the two bottom prongs 266 and horizontally away from each other as well, forming a rectangular array. Each of the four horizontally extending prongs 256 may include an end surface 270 (see FIG. 10) that together define the same contact plane 272 that is acutely angled relative to the vertical direction (Z-axis) in a plane that contains the vertical direction and the horizontal direction (X-axis) such as shown in FIG. 5. This contact plane 272 is where the slide 204 may lock the retainer plate 276 into a locking position as shown in FIG. 7.

Moreover as best seen in FIG. 10, the four horizontally extending prongs 256 that are attached to the first vertical wall 254 may define an outer perimeter 242 in a plane perpendicular to the horizontal direction (i.e. the X-axis) that surrounds the threaded aperture 258. The four horizontally extending prongs 256 may also extend at least partially in the lateral direction (i.e. parallel to the Y-axis) away from the threaded aperture 258 such that their outside lateral extremities 244 of each of the four horizontally extending prongs 256 are spaced away laterally away from the first vertical wall 254 (see distance 246). In other words, the prongs at least partially jog in a plane containing the lateral and horizontal directions.

When the prongs 256 of the slide 204 engage the retainer plate 276 as best seen in FIGS. 5 and 7, the retainer plate 276 is trapped in a notch 278 in communication with the vertically extending slot 280 of the wear member 102, preventing the removal of the retainer plate 276 along the Z direction from the vertically extending slot 280. Thus, the retainer plate 276 now prevents removal of the wear member 102 along the X direction as the bolt retention assembly 200 blocks such a movement.

Referring now to FIGS. 2 and 6, the wear member 102 may define a horizontally extending slot 282 that that is configured to accommodate the components of the bolt retention assembly 200. Other configurations are possible in other embodiments.

Looking at FIGS. 2 thru 6 as already alluded to earlier herein, the bolt retention assembly 200 may further comprise a bolt 228 including a shaft 288 and a head 290, as well as a retainer plate 276 that includes a bolt head clearance hole 292 configured to allow the head 290 of the bolt 228 to pass through the retainer plate 276 during the assembly process. The retainer plate 276 may also include an upper tab 294 defining a slot 296 that may be engaged via a tool such as a pry bar to remove the retainer plate 276 prior to tightening the bolt 228 or after loosening the bolt 228 (see FIG. 6) since the slide 204 is not yet locking the retainer plate 276 into an angled orientation where it is trapped in the notch 278 that is in communication with the vertically extending slot 280 of the wear member 102.

With continued reference to FIG. 6, the shaft 288 of the bolt 228 may pass through the bolt head clearance hole 292 of the retainer plate 276 and the clearance holes 226 of the rear adapter member 218 and engage the threads of the slide 204. The bolt head 290 may engage the rear adapter member 218 so that once the shaft 288 of the bolt 228 is threaded into the slide 204, the horizontal position of the bolt 228 is substantially fixed and cannot be removed from the assembly 200 without unthreading the bolt 228 from the slide 204. As the bolt 228 is tightened, the bolt head 290 presses on the rear adapter member 218, which in turn, presses onto the front adapter member 216 that is fixed to the working edge 104 of the work implement 100. At the same time, the slide 204 is drawn toward the bolt head 290, forcing the slide 204 along the horizontal direction (positive X direction) until the retainer plate 276 is trapped in the notch 278.

Put another way, the bolt retention assembly 200 may be configured such that tightening the bolt 228 causes the slide 204 to move away from the adapter 202 and engage the retainer plate 276 while the bolt 228 is placed under tension and the adapter 202 is placed under compression. To that end, the rearward horizontally oriented saddle portion 208 defines a maximum horizontal dimension 297 of the rearward horizontally oriented saddle portion 208 (shown in FIG. 8), while the rearward horizontally oriented pronged portion 214 defines a maximum horizontal dimension 298 (shown in FIG. 10) that is equal to or greater than the maximum horizontal dimension 297 of the rearward horizontally oriented saddle portion 208 such that the slide 204 is free to move horizontally relative to the adapter 202 and press on the retainer plate 276, being able to extend horizontally past the adapter as shown in FIG. 4. This difference creates a travel distance 299 of the slide 204 as may be seen in FIG. 3.

In FIG. 6, it can also be seen that bolt head clearance hole 292 of the retainer plate 276 is angled so that the bolt head 290 may only pass through the retainer plate 276 if the retainer plate 276 is angled forward as shown into the notch 278. That is to say, the longitudinal axis of the bolt head clearance hole forms an oblique angle with the thickness (minimum dimension) of the retainer plate 276. Other configurations are possible in other embodiments.

Any of the surfaces or features described herein may have any suitable shape including flat, arcuate, etc. The term "arcuate" includes any bowed shape including polynomial, sinusoidal, spline, radial, elliptical, etc. Similarly, any blend or transitional surface may include any of these arcuate shapes or may be flat, etc.

Furthermore, as used herein, the terms "upper", "lower", "top", "bottom", "rear", "rearward", "forward", "forwardly", front, horizontal, vertical, lateral, etc. are to be interpreted relative to the direction of assembly of the component onto a front lip of a bucket assembly or the like but also includes functional equivalents when the components are used in other scenarios. In such cases, these terms including "upper" may be interpreted as "first" and "lower" as "second", etc. Reference to a Cartesian coordinate system will also be made. Such coordinate systems inherently define an X-axis, Y-axis, and Z-axis as well as corresponding X-Y, X-Z, and Y-Z planes. The X-axis may be coextensive with the horizontal direction, the Y-axis may be coextensive with the lateral direction, and the Z-axis may be coextensive with the vertical direction. Again, this coordinate system may be interpreted relative to the direction of assembly with the X direction being aligned with the direction of assembly such that horizontal, vertical and lateral directions are not necessarily to be interpreted strictly literally but to be adapted to the application. Furthermore, any direction such as horizontal, vertical, and lateral are intended to include directions that form an angle with that direction that is less than 45 degrees.

The configuration of any embodiment of a work implement, wear member, bolt retention assembly or any of its components may be varied to be different than what has been specifically discussed herein or shown in the drawings (e.g. the shapes, angles, and dimensions may be varied as needed or desired in various embodiments). The various components of the bolt retention assembly may be manufactured from steel.

INDUSTRIAL APPLICABILITY

In practice, a work implement such as a bucket assembly may be sold with one or more wear members, bolt retention assemblies, or any of the components of the bolt retention assembly according to any of the embodiments discussed herein. In other situations, a kit that includes components for retrofitting an existing work implement or a newly bought work implement with one or more wear members, bolt retention assemblies, or any of the components of the bolt retention assembly according to any of the embodiments discussed herein may be provided.

A method 300 of attaching a wear member 102 to a work implement 100 using a bolt retention assembly 200 will now be discussed with reference to FIG. 2. First, the front adapter member may be attached to the working edge of the work implement via welding or the like (step 302). Then, the rear adapter member may installed over the slide member such that the prongs extend through the rear adapter member (step 304). Once these steps are complete, a subassembly is created (step 308, such as shown in FIG. 3).

This subassembly may then be attached to the working edge of the work implement by mating the rear adapter member to the front adapter member vertically inserting the hook portions of the rear adapter member into the T-slot of the front adapter member (step 310 in FIG. 2). Next, the wear member is inserted horizontally (positive X direction) over the working edge of the work implement such that the bolt retention assembly is inserted into the horizontally extending slot of the wear member (step 312 in FIG. 2). After that, the retainer plate may be inserted into the vertically extending slot such that its bolt head clearance hole is aligned with the clearance holes of the rear adapter member and the slide (step 314 in FIG. 2). The bolt may then be inserted through these holes and threaded into the slide (step 316). Continued tightening of the bolt causes the slide to move backwards as the nut is drawn toward the bolt head. This in turn causes the two vertical members of the slide to contact and trap the retainer plate in the notch that is in communication with the vertically extending slot of the wear member. Removal of the wear member is now prevented.

This process may be reversed to remove the wear member. After the bolt has been loosened and the slide has retreated sufficiently, the wear plate may be pushed into a vertical orientation so that is no longer trapped in the notch and may be removed from the wear member. The wear member may then be pushed horizontally (negative X direction) off the working edge of the work implement.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. Also, the numbers recited are also part of the range.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps or combined. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A bolt retention assembly defining a horizontal direction, a vertical direction, and a lateral direction that is perpendicular to the vertical direction and the horizontal direction, the bolt retention assembly comprising:

an adapter including a forward abutment portion and a rearward horizontally oriented saddle portion, the adapter also defining an interior aperture; and a slide including a forward threaded portion configured to fit within the interior aperture of the adapter, and a rearward horizontally oriented pronged portion configured to pass through the rearward horizontally oriented saddle portion of the adapter;

wherein the rearward horizontally oriented saddle portion defines a maximum horizontal dimension of the rearward horizontally oriented saddle portion, and the rearward horizontally oriented pronged portion defines a maximum horizontal dimension of the rearward horizontally oriented pronged portion that is equal to or greater than the maximum horizontal dimension of the rearward horizontally oriented saddle portion such that the slide is free to move horizontally relative to the adapter and extend horizontally past the adapter.

2. The bolt retention assembly of claim 1, wherein the adapter is split into a front adapter member and a rear adapter member configured to be attached to the front adapter member.

3. The bolt retention assembly of claim 2, wherein the front adapter member includes a vertically extending T-slot and the rear adapter member includes diametrically opposing hook portions configured to fit within the T-slot.

4. The bolt retention assembly of claim 1, wherein the forward threaded portion includes a first vertical wall defining a threaded aperture.

5. The bolt retention assembly of claim 4, wherein the rearward horizontally oriented pronged portion includes four horizontally extending prongs attached to the first vertical wall.

6. The bolt retention assembly of claim 5, wherein the rearward horizontally oriented saddle portion includes a second vertical wall that defines a horizontally extending clearance hole that extends completely through the second vertical wall, and four apertures that extend through the second vertical wall that are configured to allow the four horizontally extending prongs to pass through the second vertical wall.

7. The bolt retention assembly of claim 6, wherein the four horizontally extending prongs include two bottom prongs spaced horizontally away from each other, and two top prongs spaced vertically away from the two bottom prongs and horizontally away from each other, forming a rectangular array, and each of the four horizontally extending prongs include an end surface that together define the same contact plane that is acutely angled relative to the vertical direction in a plane that contains the vertical direction and the horizontal direction.

8. The bolt retention assembly of claim 3, wherein the forward abutment portion defines a horizontally extending thru-hole.

9. The bolt retention assembly of claim 8, wherein the rearward horizontally oriented saddle portion of the rear adapter member includes an internal rail member that defines a downward vertically facing ledge and an upwardly vertically facing ledge that are disposed in the interior aperture, the rear adapter member includes an external rail member extending laterally outwardly from the rearwardly horizontally oriented saddle portion defining a top surface substantially coplanar with the downwardly vertically facing ledge.

10. The bolt retention assembly of claim 9, wherein the internal rail member defines a first inward lateral extremity, at least one of the diametrically opposing hook portions of the rear adapter member defines a second inward lateral extremity that is spaced laterally away from the first inward lateral extremity toward the interior, and the front adapter member includes a rail extending laterally outwardly from the front adapter member that is coextensive with the external rail member of the rear adapter member.

11. The bolt retention assembly of claim 1, further comprising:

a retainer plate; and a bolt;

wherein the bolt retention assembly is configured such that tightening the bolt causes the slide to move away from the adapter and engage the retainer plate while the bolt is placed under tension and the adapter is placed under compression.

12. A slide for use with a bolt retention assembly, the slide defining a horizontal direction, a vertical direction, and a lateral direction that is perpendicular to the horizontal direction and the vertical direction, the slide comprising:

a forward threaded portion including a vertical wall that defines a threaded aperture extending horizontally through the vertical wall, and a rearward horizontally oriented pronged portion;

wherein the rearward horizontally oriented pronged portion includes four horizontally extending prongs attached to the vertical wall that define an outer perimeter in a plane perpendicular to the horizontal direction that surrounds the threaded aperture.

13. The slide of claim 12, wherein the four horizontally extending prongs include outside lateral extremities, terminate at a free end, and also extend at least partially in the lateral direction away from the threaded aperture such that the outside lateral extremities are spaced away laterally away from the vertical wall at the free end.

* * * * *